US005660459A

United States Patent [19]

Appelberg

[11] Patent Number: 5,660,459

[45] Date of Patent: Aug. 26, 1997

[54] ILLUMINATED ASSEMBLY FOR A SWITCH/ OUTLET

[75] Inventor: Gustaf T. Appelberg, Fairfield, Conn.

[73] Assignees: E-Lite Technologies, Inc., Stratford; Competitive Technologies, Inc., Fairfield, both of Conn.

[21] Appl. No.: 635,032

[22] Filed: Apr. 19, 1996

[51] Int. Cl.[6] ..... F21V 9/16

[52] U.S. Cl. ..... 362/84; 362/95; 200/310

[58] Field of Search ..... 362/84, 95; 200/310

[56] References Cited

U.S. PATENT DOCUMENTS

| | | | |
|---|---|---|---|
| D. 241,853 | 10/1976 | Spira et al. . | |
| 3,307,030 | 2/1967 | De Francisco | 362/95 |
| 3,968,356 | 7/1976 | Martin | 240/2 |
| 4,514,789 | 4/1985 | Jester | 362/95 |
| 4,561,044 | 12/1985 | Ogura et al. | 362/84 |
| 4,617,613 | 10/1986 | Rice | 362/95 |
| 4,755,913 | 7/1988 | Sleveland | 362/95 |
| 4,788,629 | 11/1988 | Handy et al. | 362/23 |
| 4,835,343 | 5/1989 | Graef et al. | 174/66 |
| 4,835,816 | 6/1989 | Graef | 16/114 R |
| 4,864,473 | 9/1989 | Tokarz et al. | 362/84 |
| 4,924,349 | 5/1990 | Buehler et al. | 361/357 |
| 4,931,911 | 6/1990 | Hanson | 362/95 |
| 5,045,755 | 9/1991 | Appelberg | 313/498 |
| 5,059,148 | 10/1991 | McKenna et al. | 445/25 |
| 5,317,488 | 5/1994 | Penrod | 362/84 |
| 5,337,224 | 8/1994 | Field et al. | 362/84 |
| 5,479,325 | 12/1995 | Chien | 362/105 |
| 5,481,442 | 1/1996 | Dickie et al. | 362/95 |
| 5,485,356 | 1/1996 | Nguyen | 362/95 |

OTHER PUBLICATIONS

"Basic Wiring" Sunset Publishing Corporation, 1995, Menlo Park CA, pp. 47–52.

"Basic Wiring" Time Life Books Inc., 1978, Alexandria VA, pp. 40–44.

Frontgate Catalog, Summer 1995, p. 64.

"Pathfinder Wallplate Night Light" brochure, distributed at Housewares Show, Chicago, Illinois, Jan. 14–17, 1996.

*Primary Examiner*—Carroll B. Dority

*Attorney, Agent, or Firm*—Michael R. Novack

[57] ABSTRACT

An illuminating apparatus for a wall switch or outlet that has a pair of terminals across which an electric potential is available, including an electroluminescent lamp plate having first and second electrode deposits on a surface thereof, and a contact plate disposed between the wall switch or outlet and the electroluminescent lamp plate and having a front surface facing the electroluminescent lamp plate and a back surface facing the switch or outlet, the contact plate having first and second conductors, each of which pass through the contact plate, the first conductor contacting the first electrode deposit and one of the terminals, and the second conductor contacting the second electrode deposit and the other of the terminals.

12 Claims, 3 Drawing Sheets

ILLUMINATED ASSEMBLY FOR A SWITCH/ OUTLET

This invention relates to an illuminated assembly and more particularly to the use of electroluminescent material in effectively illuminating wall switch/outlet devices without interfering with functionality or design.

BACKGROUND

Various designs for night light devices have been suggested. Included among the concerns in the design of night lights have been: convenience (in terms of installation and use), effective illumination, safety, and aesthetics. In addition, a continued concern with the use of night light devices in motels, restaurants, and other public places has been theft or vandalism of the night light device or the illuminated portion thereof. Although designs have been suggested for addressing one or some of these concerns, no single approach has sufficiently addressed all concerns. Therefore, there exists room for further improvement in the design of illuminated wall switch/outlet devices.

Conventional night lights, such as the one described in U.S. Pat. No. 4,931,911 comprise an electric lamp which is plugged directly into an electrical wall outlet. These types of night light devices have the drawback that the functionality of one or both of the outlets on a standard duplex wall receptacle is lost when the night light is engaged with the outlet.

U.S. Pat. No. 5,481,442 ('442), issued to Dickie et al., discloses a night light for a standard duplex wall outlet. The night light assembly disclosed in '442 includes a cover plate that has "power blades" which engage one socket of the wall outlet. Although configurations are disclosed to maintain functionality of the non-engaged outlet, the device does not allow for functionality of the engaged outlet.

In an attempt to maintain the functionality of the wall outlet assembly, U.S. Pat. No. 4,000,405, issued to Horwinski discloses a combined electrical receptacle type adapter and night light. However, the unit attached to the wall switch outlet undesirably extends from the standard outlet, and includes increased circuitry for operation of the bulb members.

Another design for a wall outlet is described in U.S. Pat. No. 4,617,613, issued to Rice. The '613 patent discloses an electrical outlet cover plate having an illuminating device fastened to the cover plate with an adhesive. The patent also discloses the use of tentacular electrical conductors which make contact with the heads of the feed and ground terminals and/or ground bracket. The contact design supplies electrical power to the illuminating device mounted on the cover plate. Although such a design allows for maintained functionality of the outlet sockets, and claims ease of installation, it does have drawbacks. The illuminated portion of the device protrudes from the cover plate, which is an unfavorable since it increases the risk of vandalism of theft of the illuminated housing, and interferes with the external flat contour of the face plate. Also, the hardware for contacting the terminals carrying electric potential does not adequately account for some types of variations in terminal location designs, so the unit could not be conveniently used with some types of wall outlets. Also, the unit does not address illumination of wall switches.

In the case of wall switches, the choices for night light illumination is further limited. The illumination of the knob region has been suggested as in U.S. Pat. No. 3,968,356. Also, designs utilizing a light-emitting diode as disclosed in U.S. Pat. No. 4,755,913 ('913), have been suggested. The light-emitting diode in this device extends through a hole in the switch wall plate, and illuminates only a small region of the switch plate. These designs do not afford substantial illumination of the wall switch.

It is among the objects of the present invention to address problems and limitations of prior art approaches to illumination of wall switch/outlet devices.

SUMMARY

In addressing the aforementioned shortcomings associated with prior art wall switch/outlet illuminating devices. Applicant provides an illuminating assembly that can be conveniently fitted to existing wall switches/outlets. The device utilizes a plate of electroluminescent material, which is mounted as a thin sheet under a translucent cover plate.

In an embodiment of the invention, the plate of electroluminescent material has electrode deposits that connect electrodes within the material with conductors that lead to an existing electric potential. In the case of a standard duplex wall outlet, an electric potential exists at the tab member portion between the upper and lower outlets. These tab portions can be contacted by pin member ends of the conductors. In the situation where tab members are not present for contact with the pin members, such as in switch plates, applicant provides a contact area by adding a small metal tab contact area to the existing screw terminals which extend to be engageable with the pin members. Such a design allows for uniformity in the structure of the device hereof since only minor, if any, modification of the outlet/switch device is necessary in order to provide an electric potential.

Applicant's design allows for illumination of the entire region of the cover plate. Since the illuminated material is placed beneath the cover plate, the device allows for the continued functionality of the wall outlet, and does not interfere with the contour of the surface of the cover plate. Further, since the device can be securely mounted beneath the face plate, it maintains safety, and reduces the likelihood of theft or vandalism.

Further features and advantages of the invention will become more readily apparent from the following detailed description when taken in conjunction with the accompanying drawings.

DETAILED DESCRIPTION

Figure 1:
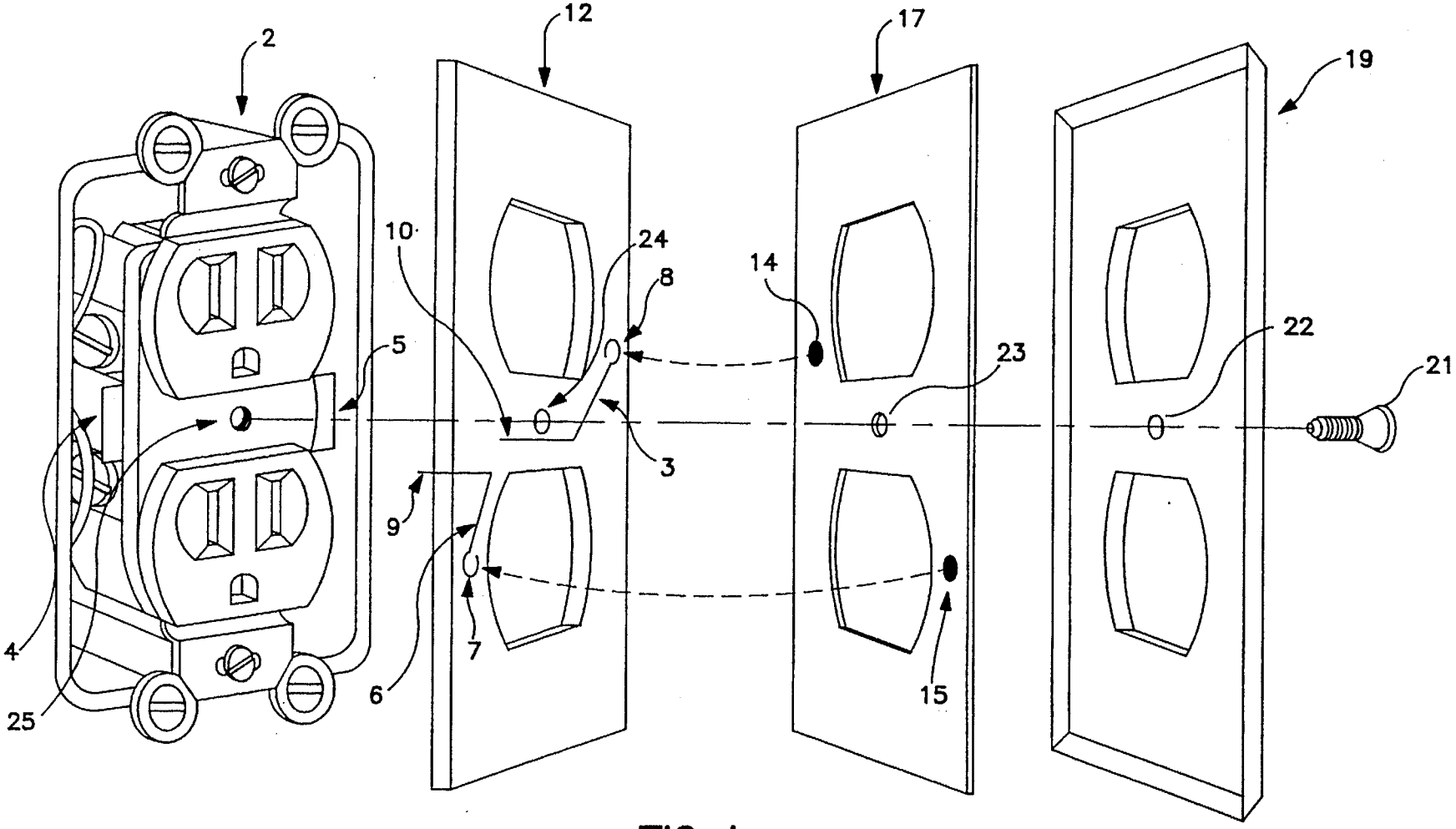
FIG. 1 is an exploded view of an embodiment of the present invention mountable on a standard duplex wall outlet.

FIG. 1 shows an embodiment of the present invention. A standard duplex wall outlet 2, having fin members 4,5 is shown. In a standard duplex wall outlet, the fin members 4,5 serve the function of allowing the wall outlet assembly to have a single switchable outlet and unswitchable outlet or duplex unswitchable outlets. The fin members 4,5 are simply broken off in order to create a switched outlet. In an embodiment of the invention, the fin members 4,5 are utilized to form a potential across which a current is available. Conductors 3 and 6 extend through a contact plate 12, and make contact with the fin members 4,5 which transfer current to the electrode deposits 14 and 15 of the electroluminescent lamp plate 17. One end of the conductors 3,6 is a spring loaded element 7,8 which contacts an electrode deposit 14,15 and the other end is a pin member 8,9, which contacts a terminal 4,5. The electroluminescent lamp plate 17, has electrode deposits 14,15 on its surface that connect the electrodes (not shown) within the electroluminescent lamp plate 17, with the spring loaded elements 6,8 of conductors 3,6. The cover plate 19, can be of any suitably sturdy translucent material, and is preferably a clear plastic. If desired, the cover plate 19, may contain regions of non translucent areas, which allows for selective illumination of the cover plate, so that illuminated shapes or numbers/letters can be formed. The electroluminescent plate 17, is of the split electrode configuration of the type in U.S. Pat. Nos. 5,045,755 and 5,019,748, sold under the brand name Elume®, manufactured by E-Lite Technologies, Inc., Stratford, Conn. The contact plate 12, can be of any suitably sturdy material (such as plastic), and includes recessed portions for receiving the connectors 3,6. Mounting screw 21, passes through apertures 22,23,24, and into threaded opening 25 to secure the cover plate 19, electroluminescent lamp plate 17, and contact plate 12. After a period of months or years, when the electroluminescent lamp plate begins to exhibit a reduction in luminescence, the lamp plate can be safely and easily replaced with a new lamp plate by simply removing the cover plate 19.

Figure 2:
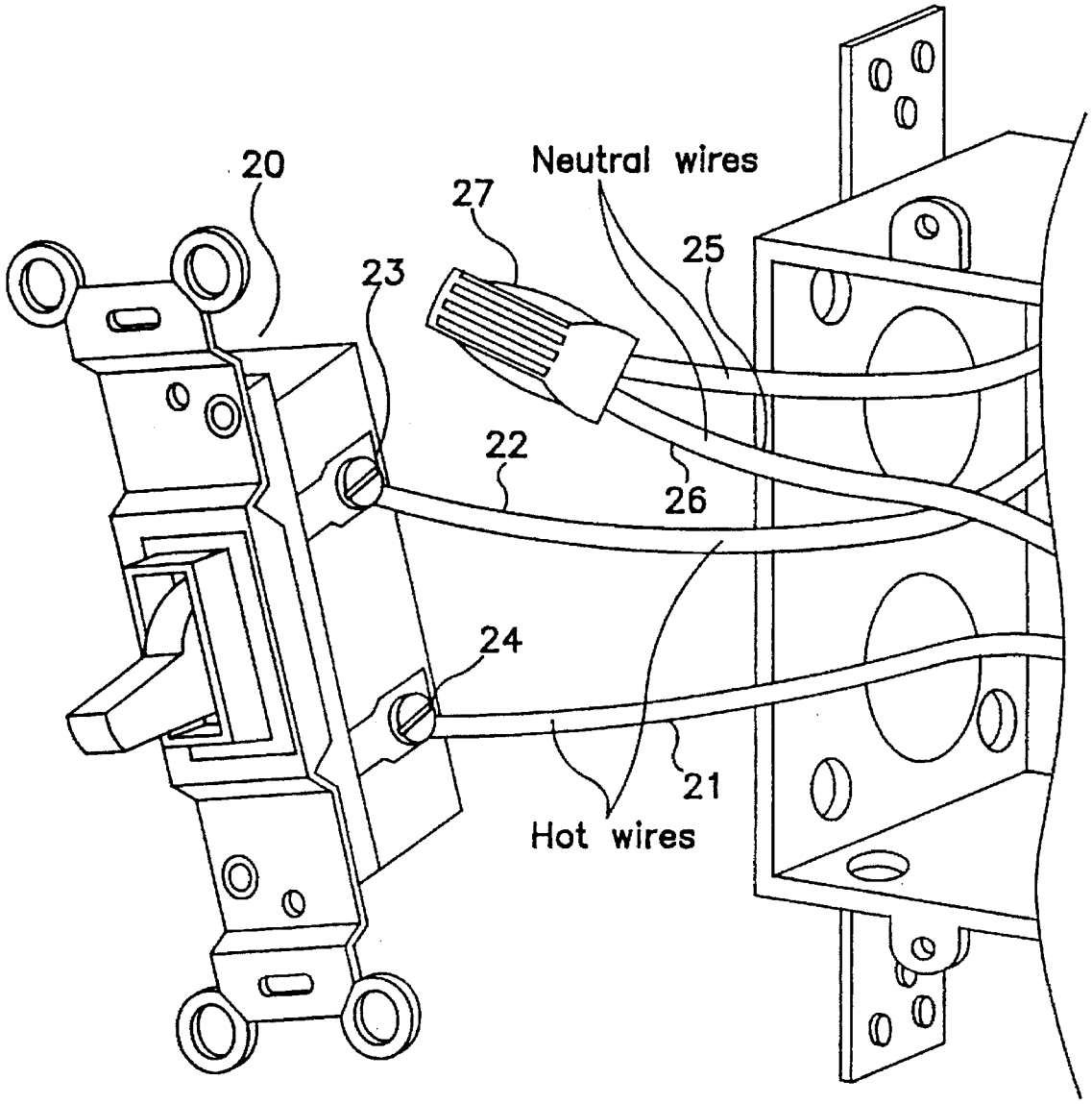
FIG. 2 is a perspective view of a standard prior art single pole switch device.

FIG. 2 shows a standard prior art single pole side-wired switch device 20. Single pole switches are the basic type most frequently used in homes. Hot wires 21 and 22 are connected to screw terminals 23 and 24. Neutral wires 25,26 are shown capped with a wire nut 27. It should be noted that three way and four way switches exist with additional screw terminals added for additional wire connections. In such situations, neutral wires 25,26 may be connected to a screw terminal on the switch.

Figure 3:
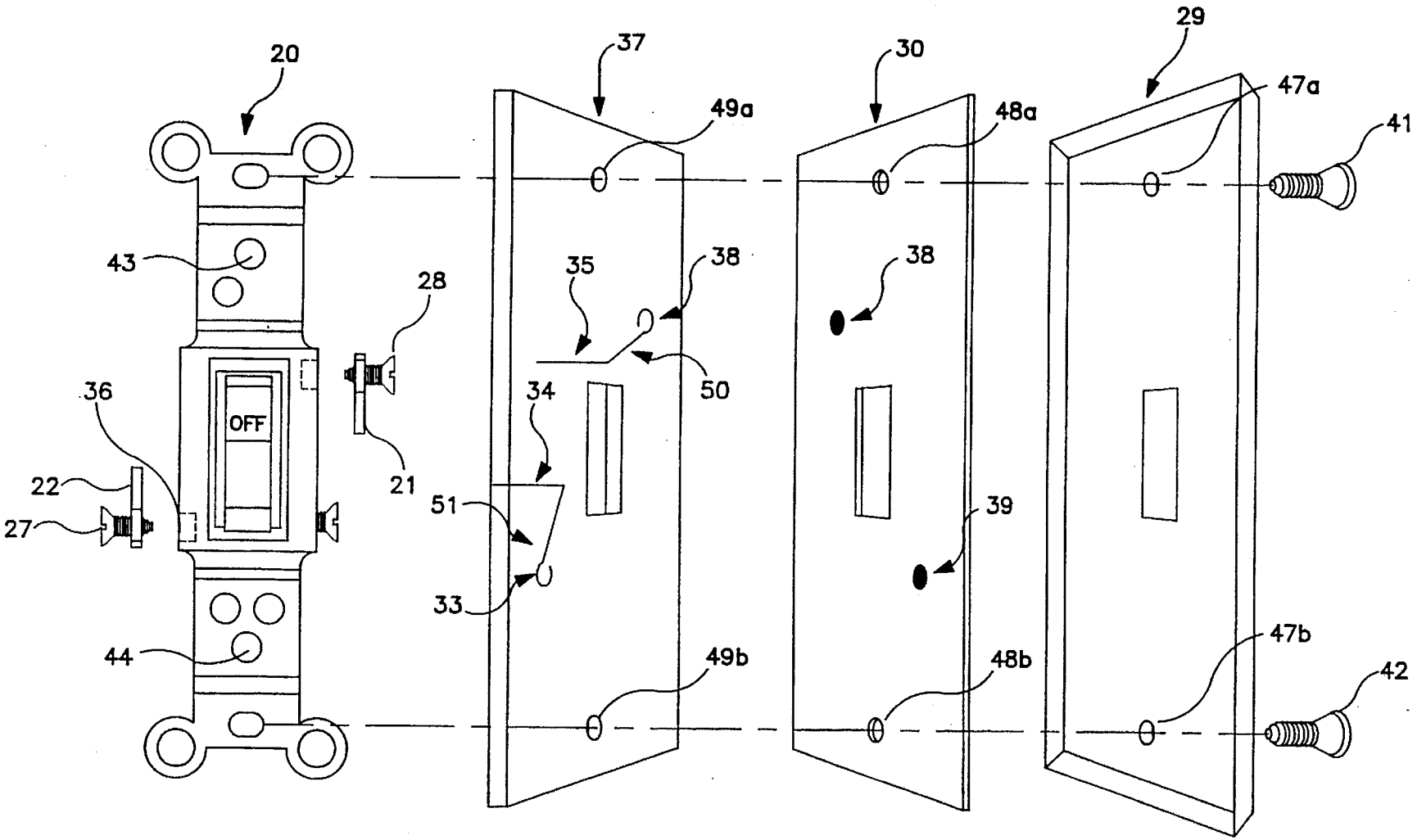
FIG. 3 is an exploded view of an embodiment of the present invention mountable on a standard wall switch.

FIG. 3 shows an illuminated switch device in accordance with an embodiment of the invention. A standard switch 20, as in FIG. 2 can be easily modified to house neutral wires 25 or 26, by the addition of a screw terminal (if necessary). Alternatively a switch assembly with additional screw terminals can be substituted for the single pole side wired switch at little additional cost. In the case of modification, a screw receiving receptacle 36 is formed 0n the switch 20, by any suitable means (such as drilling of a small hole). Screw 27 is configured to make contact with neutral wires (not shown). Metal contact members 21 and 22, are shown mounted by screw members 27 and 28. As in FIG. 1, a translucent cover plate 29, is placed over the electroluminescent lamp plate 30. The connectors 50,51 with pin member ends 34,35, extend through a contact plate 37, and make contact with their respective contact members 21,22, and the spring loaded ends 32,33 couple to their respective electrode deposits 38,39 of the electroluminescent lamp plate 30. Conventional mounting screws 41 and 42, pass through apertures **47*a*, 48*a*, 49*a*, and 47*b*, 48*b*, 49*b* (all respectively), and into their respective threaded openings 43 and 44**.

As noted above, multiple configurations of switch assemblies with one or more screw terminals exist, and alternative configurations for providing an electric potential for the electroluminescent material are envisioned. For instance, contact members can be modified to engage alternative wire switching configurations, such as with end wired or front wired configurations.

In a further embodiment of the present invention, the illuminated wall/switch outlet device can be configured with a photodetector (not shown) to sense the presence of ambient light to selectively illuminate the lamp plate under dark conditions. In this situation the photodetector can be mounted in the contact plate, and a hole region is formed in the electroluminescent lamp plate, which allows ambient light to reach the photodetector through the translucent cover plate. A standard switching circuit (not shown) would be used in conjunction with the photodetector to selectively provide current to the electroluminescent material.

I claim:

1. An illuminating apparatus for a wall switch that has a pair of terminals across which an electric potential is available, comprising;

(a) an electroluminescent lamp plate having first and second electrode deposits on a surface thereof; and (b) a contact plate disposed between said wall switch and said electroluminescent lamp plate and having a front surface facing the electroluminescent lamp plate and a back surface facing the switch, said contact plate having first and second conductors, each of which pass through the contact plate, said first conductor contacting said first electrode deposit and one of said terminals, and said second conductor contacting said second electrode deposit and the other of said terminals.

2. An apparatus as defined in claim 1, further comprising a translucent cover plate covering the electroluminescent lamp plate.

3. An apparatus as defined in claim 2, wherein said cover plate is clear.

4. An apparatus as defined in claim 3, wherein said cover plate is flat.

5. An apparatus as defined in claim 1, wherein each of said conductors comprises a spring loaded element for contact with an electrode deposit and a pin for contact with a terminal.

6. An apparatus as defined in claim 5, further comprising contact members engageable with the wall switch terminals, said pins contacting the contact members.

7. An illuminating apparatus for a wall outlet that has at least one socket and a pair of terminals across which an electric potential is available, comprising;

(a) an electroluminescent lamp plate having first and second electrode deposits on a surface thereof; and (b) a contact plate disposed between said wall switch and said electroluminescent lamp plate and having a front surface facing the electroluminescent lamp plate and a back surface facing the switch, said contact plate having first and second conductors, each of which pass through the contact plate, said first conductor contacting said first electrode deposit and one of said terminals, and said second conductor contacting said second electrode deposit and the other of said terminals in a manner which does not interfere with the insertion of an electric plug into any socket of the outlet.

8. An apparatus as defined in claim 7, further comprising a translucent cover plate facing the front surface of the electroluminescent lamp plate.

9. An apparatus as defined in claim 8, wherein said cover plate is clear.

10. An apparatus as defined in claim 9, wherein said cover plate is flat.

11. An apparatus as defined in claim 7, wherein each of said conductors comprises a spring loaded element for contact with an electrode deposit and a pin for contact with a terminal.

12. An assembly as defined in claim 11, wherein said outlet is a duplex wall receptacle having an upper and a lower receptacle and first and second fin members therebetween, wherein said pin members contact said fins.

* * * * *